US007023147B2

(12) United States Patent
Colby et al.

(10) Patent No.: US 7,023,147 B2
(45) Date of Patent: Apr. 4, 2006

(54) CONTROLLER CIRCUIT

(75) Inventors: Edward G. Colby, Cambridge (GB); Alexander C. Knill, Cambridge (GB); Simon A. Shakespeare, Cambridge (GB)

(73) Assignee: Pentair Pool Products, Inc., Moorpark, CA (US)

( * ) Notice: Subject to any disclaimer, the term of this patent is extended or adjusted under 35 U.S.C. 154(b) by 0 days.

(21) Appl. No.: 10/936,170

(22) Filed: Sep. 8, 2004

(65) Prior Publication Data

US 2005/0116665 A1 Jun. 2, 2005

(30) Foreign Application Priority Data

Sep. 9, 2003 (GB) ..... 0321008
Oct. 10, 2003 (GB) ..... 0323772

(51) Int. Cl.
*G05F 1/00* (2006.01)

(52) U.S. Cl. ..... 315/291; 315/247

(58) Field of Classification Search ..... 315/291–295, 315/312, 316, 318, 200 R, 307, 320, 224, 315/247, 219, 209 R
See application file for complete search history.

(56) References Cited

U.S. PATENT DOCUMENTS 5,736,881 A * 4/1998 Ortiz ..... 327/175
6,016,038 A * 1/2000 Mueller et al. ..... 315/291
6,150,774 A * 11/2000 Mueller et al. ..... 315/291
6,166,496 A * 12/2000 Lys et al. ..... 315/316
6,400,101 B1 * 6/2002 Biebl et al. ..... 315/291

FOREIGN PATENT DOCUMENTS

| | | |
|---|---|---|
| EP | 0 696 841 A | 2/1996 |
| FR | 2 631 102 A1 | 11/1989 |
| GB | 1 543 722 A | 4/1979 |
| GB | 1049 360 A | 4/1998 |
| WO | 02/061330 A | 8/2002 |

OTHER PUBLICATIONS

Simonetti D S L et a. : "Control conditions to Improve Conducted EMI by Switching Frequency Modulation of Basic Discontinuous PWM Preregulators." Power Electronics Specialists Conference PESC '94 Record. 25th Annual IEEE Taipei, Taiwan Jun. 20-25, 1994, New York, NY, USA, IEEE. Jun. 20, 1994, pp. 11890-1187, XP010121366, ISBN: 0-7803-1859-5.

* cited by examiner

*Primary Examiner*—Wilson Lee
(74) *Attorney, Agent, or Firm*—Pearne & Gordon LLP

(57) ABSTRACT

A circuit used to control the brightness of a number of light emitting diodes (LEDs) in an array, such that the color and brightness of the light produced by the array may be varied. The circuit is optimized to operate at high efficiency, permitting its use in confined spaces with poor cooling. The circuit permits a variety of configurations of LEDs to be controlled and driven from a range of line voltages. The circuit is further optimized to use few components to achieve its function.

10 Claims, 4 Drawing Sheets

CONTROLLER CIRCUIT

This application claims priority of United Kingdom Application No. 0321008.5, filed on Sep. 9, 2003 and United Kingdom Application No. 0323772.4, filed on Oct. 10, 2003.

FIELD OF THE INVENTION

The present invention relates to the field of lighting, and particularly, but not exclusively to controller circuits for variable color lighting fixtures typically having an array of light emitting diodes (LEDs) of differing colors.

BACKGROUND OF THE INVENTION

A light fixture comprising an array of differing color light emitting diodes (LEDs) can be used, with appropriate control, to generate a continuous range of colors of illumination. The brightness of each of the colors of LEDs in the light fixture may be controlled by modulating the drive current with which the LEDs are supplied, and the lifetime of the LED can be maximized if such drive currents are uniform over time.

Many examples exist of control circuits exploiting pulse width modulation (PWM) control of the average time that the LEDs are connected to a voltage source. In these cases, it is assumed that the current-voltage characteristic of the LEDs will remain constant over time, so that the peak current through the LEDs will be constant for a constant voltage source. The average current is then a function of the PWM fraction with which the LEDs are driven. In such schemes, the actual brightness of the LEDs will vary as their characteristics vary, with temperature and age, for example, and the PWM fraction required for a given brightness will vary between LEDs and with the number of LEDs driven. However, these schemes have an advantage in that only a single voltage source is required for all the LEDs in the array.

For example, in published international PCT patent application no. PCT/US01/50156 (WO 02/061330), methods and apparatus for illuminating liquids are described. In one described example, multicolor LED light sources are employed to achieve a wide range of enhanced lighting effects in liquids; such liquids include water in pool or spa environments. In another example, a pool or spa is illuminated by one or more multicolored light sources that may be employed as individually and independently controllable devices, or coupled together to form a networked lighting system to provide a variety of programmable and/or coordinated color illumination effect in the pool or spa.

Moreover, in U.S. Pat. No. 6,016,038, LED systems capable of generating light for illumination and display purposes, and methods of operating such systems are described. The LEDs are capable of being controlled by a processor to alter the brightness and/or color of light radiation emitted therefrom, such control using PWM signals. Thus, illumination from the LED systems is susceptible to being controlled by a computer program to provide complex, pre-designed patterns of light in virtually any environment. U.S. Pat. No. 6,150,774 is a further example of a PWM-based implementation of a LED lighting system.

However, PWM control of LEDs is not always technically appropriate and alternative approaches to conventional PWM control may capable of providing at least one of lower manufacturing cost, more efficient power conversation when energizing LEDs, or greater physical compactness. In order to overcome the problem of variation in brightness of LEDs driven from a constant voltage source with PWM control, it is possible to exploit the use of current mode control of the LED brightness. This current mode control can be achieved either by introducing a fixed current limit to each PWM pulse or by using a variable current source for each group of LEDs to be controlled. In the former case, the LEDs are driven with a discontinuous waveform, thereby comprising their lifetime for a given brightness; in the latter, each variable current source entails significant extra cost.

LED-based lights can also be powered from a wide variety of supplies. Further, it is of benefit if a single control circuit can be used for a wide variety of LED array configurations.

LEDs are inherently more efficient than incandescent light sources. In applications where the light fixture is to be mounted in confined spaces, this can be a considerable advantage as less waste heat is lost. In these applications, the efficiency of the controller circuit is also important. For example, circuits employing switch-mode circuit techniques offer considerably higher efficiencies for power conversion and current regulation than linear equivalents. A LED driver circuit is disclosed in U.S. Pat. No. 5,736,881. The circuit disclosed in this patent includes a quasi-resonant circuit as its constant current source.

The present invention affords an improved power controller circuit that is especially appropriate, but not limited to, controlling power delivered to LEDs to modulate their brightness.

BRIEF SUMMARY OF THE INVENTION

According to one aspect of the invention, herein described, is a controller circuit for an array of light emitting diodes (LEDs) that uses a single constant current source, a multiplexer, and a short circuit to control the current supplied to a number of LEDs in a lighting array. An algorithm executed, for example, by a microcontroller rapidly switches the output of the current source between the various LEDs and a short circuit by varying the average time that each of the LEDs is connected to the current source so the average current for that LED can be set. The current source output is switched to the short circuit during the intervals when none of the LEDs are connected, thereby allowing a simple, constant current source to be used. In order to maximize the lifetime of the LEDs, an output filter may be incorporated into each LED drive channel so as to smooth out the current waveform applied to the LEDs.

In one embodiment of the invention, the current source is a switched mode converter circuit and the multiplexer is incorporated into the switch-mode circuit. This configuration offers the additional advantages of reducing the complexity of the controller and improving its power efficiency. When the switching frequency of the multiplexer is arranged to be synchronous with the switching frequency of the current source, additional improvements in efficiency are made by switching the multiplexer during the charging phase of the converter. When combined with a switch-mode current source, the number of components required for the output filters may be reduced as some may be shared between the various output channels.

BRIEF DESCRIPTION OF THE DRAWINGS

An embodiment of the invention will now be described, with reference to the accompanying drawings in which.

DETAILED DESCRIPTION OF THE INVENTION

Figure 1:
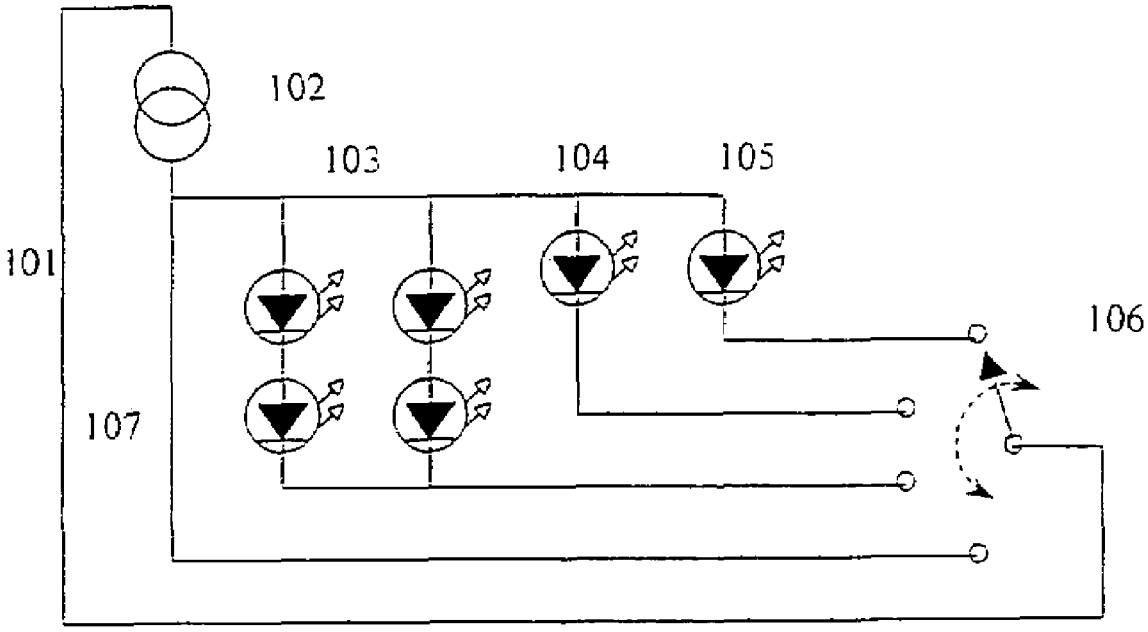
FIG. 1 is a schematic diagram of an embodiment of a lighting circuit according to the present invention.

FIG. 1 shows a general lighting circuit 101 embodying the present invention. The circuit 101 includes a constant current source 102 for supplying independent circuit branches 103, 104, 105 equipped respectively with light emitting diodes (LEDs) and a short circuit conductor 107. A multiplexer 106 provides means for independently selecting one of more of the diode branches 103, 104, 105 and the short circuit 107.

Figure 2:
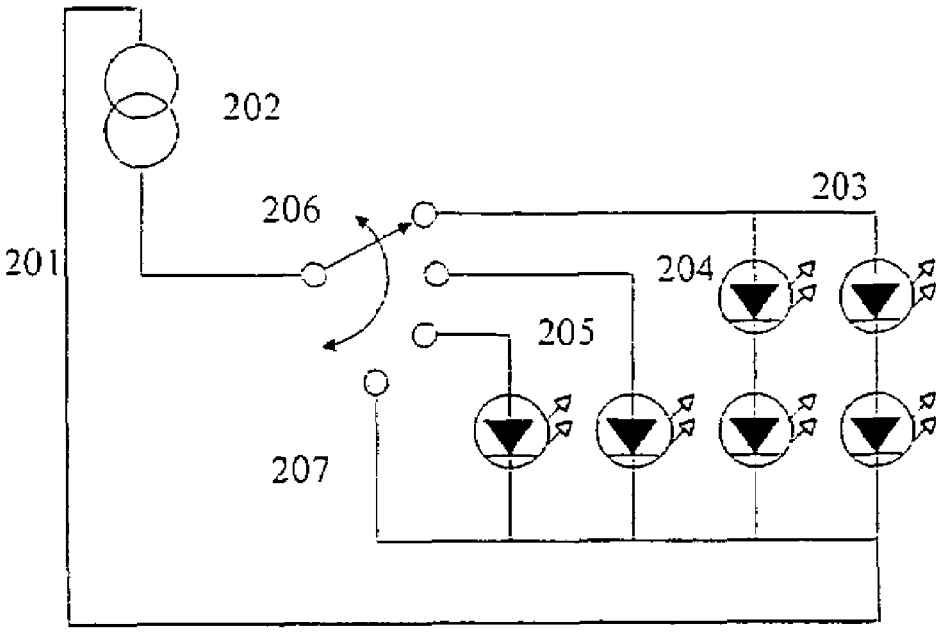
FIG. 2 is a schematic diagram of a further embodiment of a lighting circuit according to the present invention.

FIG. 2 shows another example of a general lighting circuit 201. The circuit 201 includes a constant current source 202, various branches equipped with LEDs 203, 204, 205, a short circuit 207, and a multiplexer 206. Notwithstanding the different circuit layout of FIG. 2, these lighting circuits 101, 102 may be regarded as functionally equivalent.

In use, the multiplexer 106, 206 is driven by a control circuit capable of switching among the diode and short-circuit connections. The control circuit switching modes are designed to vary the average time that each of the LED branches is connected to the current source to set an average current value for each LED. The current is switched through the short circuit during intervals when none of the LEDs is required to be emitting. This allows a simple constant current source to be used.

Figure 3:
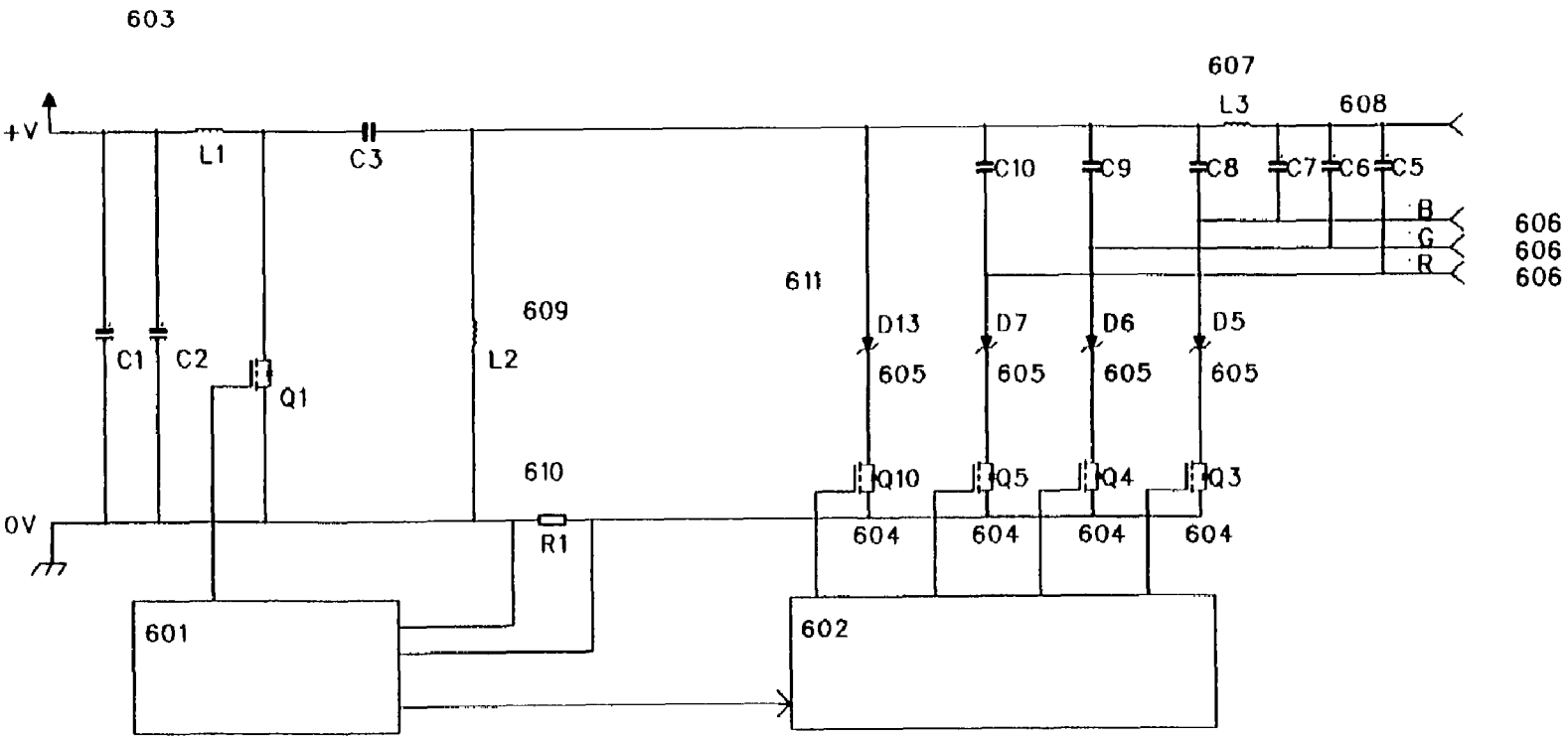
FIG. 3 is a schematic diagram of an embodiment of a controller, with the multiplexer integrated into the current controlled switched mode converter and the control of the multiplexer operated synchronously with the switching of the converter.

With referenced to FIG. 3, the control circuit consists of a current controlled single-ended primary inductance converter (SEPIC) 603 and four current steering field effect transistors (FETs) 604 controlled by a microcontroller 602. The FETs are switched in such a way as to steer the output current of the converter to one of three different LED drive channels 606 or to a short circuit 611. The three LED drive channels are used to drive different color LEDs B, G, R so as to allow the total color of the light produced to be varied.

The SEPIC runs at a frequency of approximately 100 kHz, though the exact frequency is dependent upon line and load conditions. During the on-period of the SEPIC switching cycle, the output of the converter may be multiplexed to a different output channel 605 or to the short circuit 611. During this part of the cycle, no current flows out of the SEPIC. During the off-period of the SEPIC, a pulse of current flows through the channel selected by the multiplexer FET 604. The output rectification required by the SEPIC topology is provided in each output channel so as to allow single low-side FETs to be used to multiplex between 15 channels.

In each channel, a capacitor, inductor, capacitor filter 607, 608 is used to average out the current applied to the LEDs; though as a result of this example circuit topology, the inductor of these filters is shared among all channels. At any time, the output of the converter is applied to only one output channel or the short circuit.

The total output color of the light is determined by the ratio of the average amount of time that the LED output channels spend connected to the current source. This corresponds to the ratio of the frequencies of pulses from the SEPIC converter into the LEDs. The overall brightness of the light is determined by the ratio of the total time that all the channels spend connected to the source, to the time that the source is connected to the short circuit. This corresponds to the ratio between the sum of the frequencies of pulses sent to the LED channels, compared to the operating frequency of the SEPIC. In this way, the microcontroller algorithm is able to control the brightness and color of the light.

Figure 4:
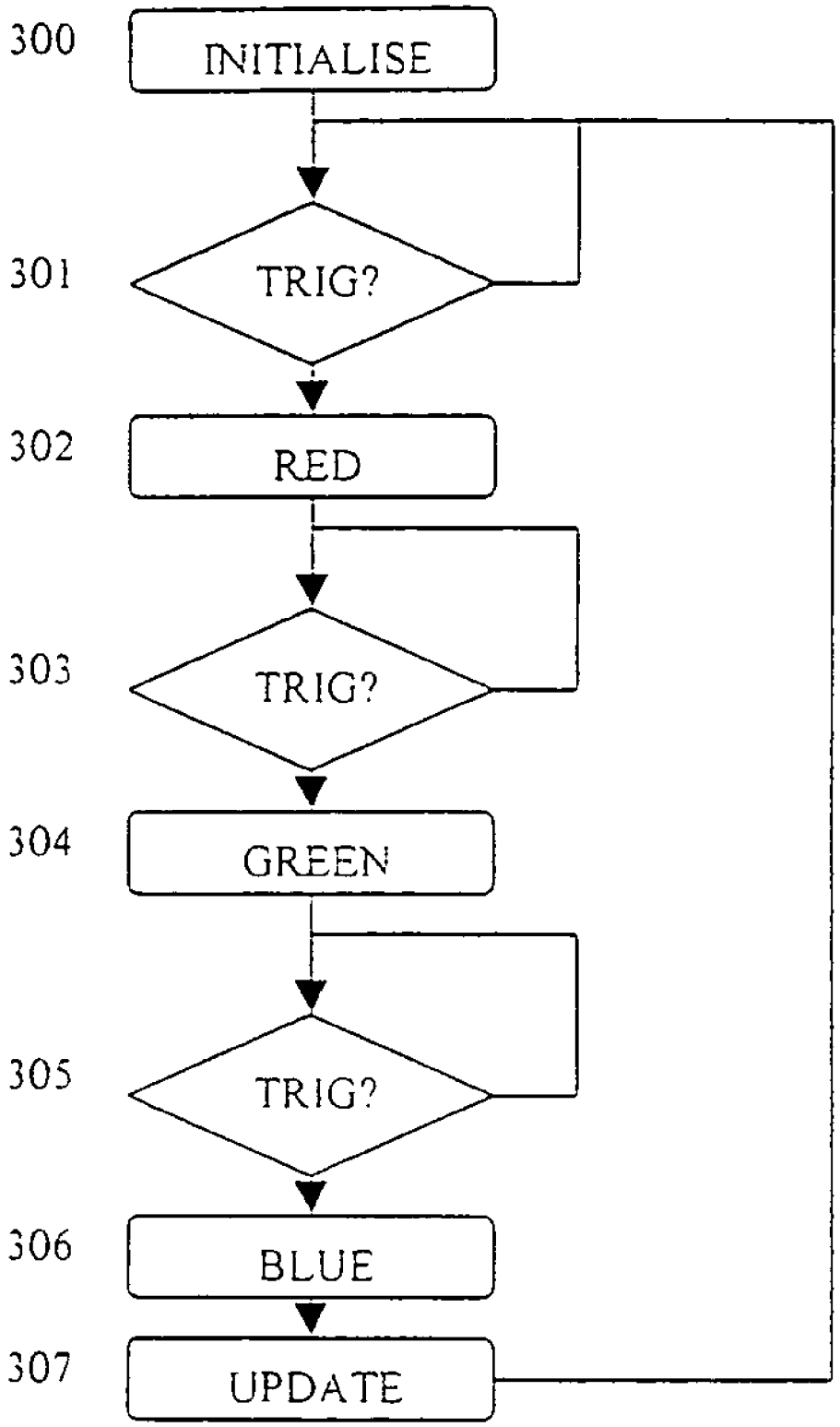
FIG. 4 is a flowchart of the operation of the control algorithm of a preferred controller circuit.

With reference to FIG. 4, at each cycle of the converter, a state machine in the control algorithm is updated. Following an initialization routine 300, the algorithm waits for the on-period of the converter to start 301. For each channel in sequence, the algorithm calculates 302, 304, 306 whether the average current delivered is above or below that required, and switches the output of the converter to the channel or to the short circuit as appropriate. Between the calculation for each channel, the algorithm waits for the next on-period of the converter 303, 305.

Figure 5:
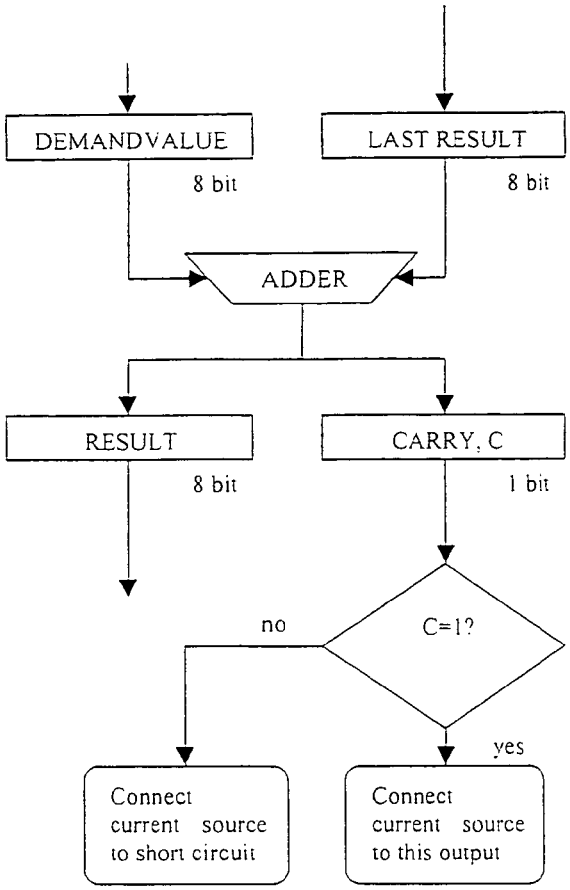
FIG. 5 is a flowchart of the algorithm that determines the state of the multiplexer in any time slot.

With reference to FIG. 5, a demand value for each channel is stored as a number between 0 and 255. At each calculation, this value is added to an 8-bit accumulator dedicated to that channel. If the result of the addition is a number greater than 255, a carry is generated, and this carry is used to signal that the current source should be connected to this output channel for this time period. The 8-bit result of the addition is stored in the channel accumulator for use in the next calculation for this channel. In this way, the average amount of time that a channel is connected to the current source is proportional to the demand value.

Figure 6:
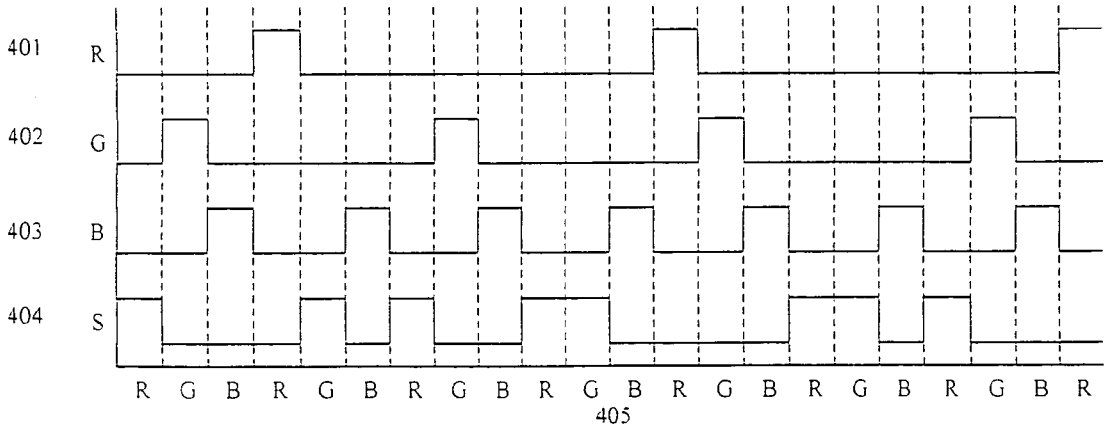
FIG. 6 is a plot of drive waveforms.

FIG. 6 is a plot of the drive waveforms for the multiplexer such that a first channel is driven with 33% of its maximum output current, a second channel is driven with 50% of its maximum output current, and a third channel is driven with 100% of its maximum output current. The spare current from the current source is recirculated through the short circuit load. The gate drive waveforms produced are based on the following demand values: the R channel demand value is approximately 256/3; the G channel demand value is 128; and the B channel demand value is 255. Any given time slot is dedicated to either the R, G or B channels, and depending upon the results of the calculations for each channel, the multiplexer is switched either to that channel or to the short circuit, as indicated by the S channel waveform, for that time slot.

As the algorithm waits for the on-period of the converter before updating the multiplexer, the current steering occurs at the switching frequency of the converter (i.e., typically 100 kHz). Thus, with the action of the output smoothing capacitors 608, the output smoothing inductor 607, and the output inductance of the SEPIC converter 609, the ripple current in the LEDs is kept to a manageable level regardless of the LED forward voltage drop Vf.

The mean current output of the SEPIC is regulated at 2.1 A by means of a current feedback circuit 601 based on a single sense resistor 610 connected to the sources of the multiplexer FETs. In the preferred embodiment, the SEPIC uses a constant off-time, and an on-time controlled by the feedback loop. In operation, therefore, the frequency of operation of the SEPIC will vary as the total power delivered by all the output channels is changed.

For a three-channel LED system, the maximum current that can be applied to each channel is 700 mA (2.1A/3). In the case where 50% brightness is required, for example, each channel is connected to the current source for approximately 17% of the time, resulting in 2.1A*17% =350 mA, whilst the short circuit would be connected for the remainder of the time and hence would be sinking 2.1A*50% =1.05 A. Relating this to the frequency of operation, if the SEPIC runs at 100 kHz under these conditions, then each channel would receive pulses at an average frequency of 17 kHz, and the short circuit would receive pulses at an average frequency of 50 kHz. At 100% brightness, the SEPIC will run at a lower frequency, because the on-time required will be longer and the off time is constant. If this frequency were, for example, 90 kHz, then each LED channel would receive pulses at an average frequency of 30 kHz.

In the case where one or more of the output channels becomes disconnected from the LEDs, the current source will spend a portion of time driving an open circuit. In this case, the excessive output voltages generated can damage the current source, the multiplexer, and the filtering components. In order to prevent such damage, a circuit is included to shut down the converter in the case that the load line voltage of the source exceeds its designed maximum.

A skilled person in the art would appreciate that various other embodiments and modifications thereof are possible without departing from the invention as defined in the claims. While the invention has been described with reference to a specific embodiment, various changes may be made and equivalents may be substituted for elements thereof by those skilled in the art without departing from the scope of the invention. In addition, other modifications may be made to adapt a particular situation or method to the teachings of the invention without departing from the essential scope thereof. The present invention herein is not to be construed as being limited, except insofar as indicated in the appended claims.

What is claimed is:

1. A controller circuit comprising:

means for receiving a substantially constant average current from a pulsed current source;

at least two channels each incorporating at least one light emitting diode (LED) and a further channel for acting as a short circuit;

multiplex means arranged to selectively direct current pulses to one of said channels, and to control the frequency with which current pulses are directed to the channels incorporating at least one LED and the frequency with which the current pulses are directed to said channel acting as a short circuit; and means for varying the ratio of frequencies with which the current pulses are directed to said channels to control the intensity of the LEDs, wherein the current source comprises a switch-mode converter circuit and the multiplex means is operable to switch at a frequency which is substantially synchronous with the switching frequency of the switch-mode converter circuit and during a charge phase thereof.

2. A circuit according to claim 1, wherein the LEDs are of different colors and form part of a same lighting fixture, such that, in use, varying said ratio of frequencies causes the overall color of the fixture to be varied.

3. A circuit according to claim 1, wherein the switch-mode converter circuit is a single-ended primary inductance converter (SEPIC).

4. A circuit according to claim 1, further comprising means for varying the frequency of the converter circuit in response to one of the input voltage and the desired light intensity.

5. A circuit according to claim 3, wherein the SEPIC has an off-time and an on-time, and means are provided to maintain said off-time substantially constant and to vary said on-time dependant on one of the input voltage and the load requirement of the channels, thereby substantially maintaining a constant average current.

6. A controller circuit comprising:

means for receiving a constant average current from a pulsed current source;

at least two channels incorporating at least one light emitting diode (LED) and a further channel acting as a short circuit;

multiplex means arranged to selectively direct current pulses to one of said channels, and to control the time current pulses which are directed to the channels incorporating at least one LED and the time current pulses which are directed to said channel acting as a short circuit;

means for varying the ratio between the time current pulses which are directed to said channels incorporating LEDs and the time current pulses which are not directed to said channels incorporating LEDs to control the intensity of the LEDs, wherein the constant current source comprises a switch-mode converter and the multiplex means is operable to switch at a frequency which is substantially synchronous with a switching frequency of the switch-mode converter and during a charge phase thereof.

7. A circuit according to claim 6, wherein the LEDs are of different colors and form part of a same lighting fixture, such that, in use, varying said ratio of time, varies the overall color of the fixture.

8. A circuit according to claim 6, wherein the switch-mode converter circuit is a single-ended primary inductance converter (SEPIC).

9. A circuit according to any of claim 6, further comprising means for varying the frequency of the converter circuit in response to one of the input voltage and the desired light intensity.

10. A circuit according to claim 8, wherein the SEPIC has an off-time and an on-time, and means are provided to maintain said off-time substantially constant and to vary said on-time dependant on one of the input voltage and the load requirement of the channels, thereby substantially maintaining a constant average current.

* * * * *